US005385802A

United States Patent [19]

Inaba et al.

[11] Patent Number: 5,385,802

[45] Date of Patent: Jan. 31, 1995

[54] PROCESS FOR PRODUCING TONER

[75] Inventors: Yoshihiro Inaba; Tsutomu Kubo; Koichi Takashima, all of Kanagawa, Japan

[73] Assignee: Fuji Xerox Co., Ltd., Tokyo, Japan

[21] Appl. No.: 769,250

[22] Filed: Oct. 1, 1991

[30] Foreign Application Priority Data

Oct. 8, 1990 [JP] Japan ..... 2-268317
Jan. 14, 1991 [JP] Japan ..... 3-078657

[51] Int. Cl.[6] ..... G03G 9/093; G03G 9/097

[52] U.S. Cl. ..... 430/137; 430/110; 430/138

[58] Field of Search ..... 430/137, 138, 110, 115

[56] References Cited

U.S. PATENT DOCUMENTS

| | | | |
|---|---|---|---|
| 4,224,396 | 9/1980 | Pollet | 430/107 |
| 4,626,490 | 12/1986 | Yamazaki et al. | 430/138 |
| 4,661,439 | 4/1987 | Ruskin | 430/449 |
| 4,758,495 | 7/1988 | Yamaguchi et al. | 430/138 |
| 4,837,394 | 6/1989 | Alexandrovich et al. | 430/110 |
| 4,840,863 | 6/1989 | Otsu et al. | 430/110 |
| 5,079,125 | 1/1992 | Anno et al. | 430/11 |
| 5,126,225 | 6/1992 | Wilson et al. | 430/108 |

FOREIGN PATENT DOCUMENTS

| | | |
|---|---|---|
| 54-124731 | 9/1979 | Japan . |
| 57-179860 | 11/1982 | Japan . |
| 58-66948 | 4/1983 | Japan . |
| 58-120263 | 7/1983 | Japan . |
| 58-145964 | 8/1983 | Japan . |
| 59-148066 | 8/1984 | Japan . |
| 59-162562 | 9/1984 | Japan . |
| 59-185353 | 10/1984 | Japan . |
| 59-187352 | 10/1984 | Japan . |
| 59-187357 | 10/1984 | Japan . |
| 60-126656 | 7/1985 | Japan . |
| 63-163373 | 7/1988 | Japan . |

*Primary Examiner*—Roland Martin
*Attorney, Agent, or Firm*—Finnegan, Henderson, Farabow, Garrett & Dunner

[57] ABSTRACT

A novel process for producing a toner excellent in environmental stability of chargeability is disclosed, which comprises subjecting toner particles comprising on the surface thereof a polymer containing as monomer component a monomer having a salt structure consisting of an anionic component and a cationic component to ion exchange to replace the another anionic component with another anionic component.

4 Claims, No Drawings

PROCESS FOR PRODUCING TONER

FIELD OF THE INVENTION

The present invention relates to a process for producing an electrophotographic toner.

BACKGROUND OF THE INVENTION

As electrophotographic toners for developing electrostatic latent images formed on the surface of electrophotographic photoreceptors, electrostatic recording media, etc., there have been heretofore proposed many materials. For example, JP-A-54-124731 (the term "JP-A" as used herein means an "unexamined published Japanese patent application") discloses an electrophotographic toner comprising a specified quaternary ammonium polymer. JP-A-59-185353 and 59-187357 disclose a capsule toner comprising a specific quaternary ammonium polymer incorporated in the shell of a capsule. In these toners, anionic components to be contained in the quaternary ammonium polymer are halogens. Further, JP-A-58-120263 discloses an electrophotographic toner comprising a quaternary ammonium group-containing polymer containing as anionic components p-toluenesulfonic acid ion.

However, as a result of studies made by the inventors it has been found that quaternary ammonium group-containing polymers containing as anionic components a halogen ion, a p-toluenesulfonate acid ion or a methylsulfate ion deteriorate the chargeability of toner under high temperature and humidity conditions and thus provide a toner having a poor environmental stability.

In general, processes for producing a polymer containing a quaternary ammonium group comprises quaterizing a corresponding amino group-containing polymer with an alkyl halide (e.g., butyl bromide), benzyl chloride, alkyl p-toluenesulfonate or dimethyl sulfate. However, these processes require a solvent for dissolving or swelling the polymer. This solvent needs to be recovered upon after-treatment. Further, some amino groups need to be processed at a high temperature and a high humidity and thus requires a special apparatus. Moreover, anionic components are limited to halogen ions, a p-toluenesulfonate ion or a methylsulfurate ion.

Other processes for producing a polymer containing a quaternary ammonium group include a process which comprises polymerizing monomers containing a quaternary ammonium group. In accordance with this process, monomers containing anionic components in various forms can be subjected to polymerization. However, it requires much time and labor to prepare monomers containing such anionic components. Some monomers are subject to a change in reactivity which causes a change in the content of quaternary ammonium groups in the polymer resulting in a change in the charged amount of toner particles.

In order to incorporate a quaternary ammonium group in known toners, JP-A-54-124731 and 58-120263 use the former method. JP-A-59-185353 and 59-187357 use the latter method.

Thus, the prior art electrophotographic toners have disadvantages both in their electrophotographic properties and preparation method.

SUMMARY OF THE INVENTION

It is therefore an object of the present invention to provide a process for economically producing a toner having excellent environmental stability in chargeability, which can enjoy a high degree of freedom in selection of materials, and which requires no special reactor or complicated operations.

The above object of the present invention is accomplished by a process involving a step of subjecting toner particles comprising on at least the surface thereof a polymer containing as monomer component a monomer having a salt structure consisting of an anionic component and a cationic component to ion exchange to replace said anionic component with another anionic component.

DETAILED DESCRIPTION OF THE INVENTION

The process of the present invention can be applied to any known electrophotographic toners and particularly suitable for preparation of capsule toners comprising a core and a shell.

The present invention will be explained with reference to application to capsule toners.

Capsule toners can be prepared by any interfacial polymerization process such as those disclosed in JP-A-57-179860, 58-66948, 59-148066 and 59-162562. Preferred examples of resins constituting the shell include a polyurea resin, polyurethane resin, polyamide resin, polyester resin, epoxy resin, epoxyurea resin or epoxyurethane resin. Particularly preferred among these resins are polyurea resin and polyurethane resin, singly or in combination, or epoxyurea resin and epoxyurethane resin, singly or in combination.

The core of capsule toner mainly comprises a pressure-fixable component or a heat-fixable component if the toner is used for the purpose of fixing under pressure or heat, respectively. In particular, if fixing under pressure is desired, the core preferably comprises as main components a binder resin, a high boiling solvent capable of dissolving the binder resin and a coloring material, or mainly comprises a soft solid substance and a coloring material. If fixing under heat is desired, the core preferably comprises as main components a heat-melting resin and/or a soft solid substance and a coloring material. If necessary, the coloring material may be replaced by a magnetic powder, or an additive such as silicone oil may be added for the purpose of improving fixability. Further, a high boiling solvent incapable of dissolving the binder resin may be also added to the high boiling solvent capable of dissolving the binder resin. The type and percentage composition of the constituents of the core are preferably changed depending on the fixing mode, i.e., fixing under pressure or heat. For example, the core for the pressure-fixation generally contains a larger amount of the high boiling solvent than that for the heat-fixation. More specifically, the former generally contains 0.1 to 10 times the weight of the binder resin used therein and the latter contains not more than 0.1 times the weight of the binder resin used therein.

Known fixing resins can be used as binder resin of the core, and examples include acrylic ester polymers such as polymethyl acrylate, polyethyl acrylate, polybutyl acrylate, poly-2-ethylhexyl acrylate and polylauryl acrylate, methacrylic ester polymers such as polymethyl methacrylate, polybutyl methacrylate, polyhexyl methacrylate, poly-2-ethylhexyl methacrylate and polylauryl methacrylate, copolymers of styrene monomer and acrylic ester or methacrylic ester, ethylenic polymers and copolymers thereof such as polyvinyl acetate, polyvinyl propionate, polyvinyl butyrate, polypropylene and polypropyrene, styrenic copolymers such as styrene-butadiene copolymer, styrene-isoprene copolymer and styrene-maleic acid copolymer, polyvinyl ether, polyvinyl ketone, polyester, polyamide, polyurethane, rubber, epoxy resin, polyvinyl butyral, rosin, modified rosin, terpene resin, and phenol resin. These binder resins may be used singly or in admixture.

The binder resin may be incorporated in the system in the form of monomer so that it can be polymerized to form a binder resin after completion of encapsulation.

As high boiling solvent for dissolving such a binder resin there can be used an oil-soluble solvent having a boiling point of 140° C. or higher, preferably 160° C. or higher. Such a high boiling solvent can be selected from those described as plasticizers in "Modern Plastics Encyclopedia" (1975–1976). Alternatively, as such a high boiling solvent there can be selected from those disclosed as core substance for pressure-fixed capsule toner in JP-A-58-145964 and 63-163373.

Specific examples of such a high boiling solvent include phthalic acid esters (e.g., diethyl phthalate, dibutyl phthalate), aliphatic dicarboxylic acid esters (e.g., diethyl malonate, dimethyl oxalate), phosphoric acid esters (e.g., tricresyl phosphate, trixylyl phosphate), citric acid esters (e.g., o-acetyltriethyl citrate), benzoic acid esters (e.g., butyl benzoate, hexyl benzoate), aliphatic acid esters (e.g., hexadecyl myristate, dioctyl azipate), alkyl naphthalenes (e.g., methyl naphthalene, dimethyl naphthalene, monoisopropyl naphthalene, diisopropyl naphthalene), alkyldiphenyl ethers (e.g., o-, m-, p-methyldiphenyl ether), higher aliphatic or aromatic sulfonic amide compounds (e.g., N,N-dimethyllauroamide, N-butylbenzene sulfonamide), trimellitic esters (e.g., trioctyl trimellitate), diarylalkanes (e.g., diarylmethane such as dimethylphenylmethane, diarylethane such as 1-phenyl-1-methylphenylethane, 1-dimethylphenyl-1-phenylethane and 1-ethylphenyl-1-phenylethane), and chlorinated paraffins. If a polymer having a long chain alkyl group such as methacrylic lauryl homopolymer or copolymer is used as binder polymer, aliphatic saturated hydrocarbons or organic solvents comprising as a main component an aliphatic saturated hydrocarbon (e.g., Isopar, Isopar-H and Isopar-L available from Exxon Chemical) may be used.

Examples of coloring material include inorganic pigment such as carbon black, red oxide, Prussian blue and titanium oxide, azo pigment such as fast yellow, disazo yellow, pyrazolone red, chelate red, brillant carmine and parabrown, phthalocyanine such as copper phthalocyanine and metal-free phthalocyanine, and condensed polycyclic pigment such as flavanthrone yellow, dibromoanthrone orange, perylene red, quinacridone red and dioxazine violet. Alternatively, a disperse dye, oil-soluble dye or the like may be used. Further, the black coloring material may be entirely or partly replaced by a magnetic powder to form a magnetic one component toner. As such a magnetic powder there can be used powder of magnetite, ferrite, metals such as cobalt, iron and nickel, or alloy thereof. A magnetic powder which has been surface-treated with a coupling agent such as silane coupling agent and titanate coupling agent or an oil-soluble surface active agent or covered by an acrylic resin, styrene resin or epoxy resin may also be used.

As soft solid substance, any substance having flexibility and fixability at room temperture can be used, such as lauryl acrylate or methacrylate polymers, stearyl acrylate or methacrylate polymers, styrene-lauryl acrylate or methacrylate copolymers, styrene-butadiene copolymers, polybutadiene, polyolefins, polyesters and rubbers. A polymer having a glass transition temperature (Tg) of −60° C. to 5° C. or a mixture thereof with other polymers is preferred.

In the preparation of capsule toners, the thickness of the shell may be preferably altered depending on whether fixing under pressure or heat is desired. The type and percent composition of the constituents may also be altered depending on the fixing mode. The thickness of the shell is generally from 0.01 to 0.2 times and from 0.002 to 0.1 times the average particle diameter of the capsule toner when it is designed for the pressure-fixation and the heat-fixation, respectively. In case of the capsule toner for the heat-fixation, the shell is preferably made of heat-melting polyurea resins and/or heat-melting polyurethane resins.

Incorporation of the binder resin in capsules as one of core constituents can be accomplished by a process which comprises charging the binder resin into a reaction system with other core constituents, low boiling solvent and shell constituents, conducing an interfacial polymerization to form a shell, and at the same time or after completion of the shell formation, expelling the low boiling solvent from the system to form a core. Alternatively, a process may be employed which comprises charging monomer components of the binder resin in a reaction system with the other materials as described above, conducting an interfacial polymerization to form a shell, and then allowing the monomer components to be polymerized to form a core.

While the present invention is explained with reference to application to capsule toners as above, the present invention can also be applied to conventional toners having a coloring material and/or a magnetic powder dispersed in a binder resin, which are prepared by a process comprising melt-blending the components of toner, solidifying the melt and pulverizing the solid product, or a spray drying process.

In the present invention, the polymer comprising as monomer component a monomer having a salt structure consisting of the anionic and cationic components as described below is physically or chemically bonded to the surface of toner particles by a process which comprises coating the polymer or a mixture of the polymer with other polymers on the toner surface by spray drying process, coacervation process, interfacial precipitation process or the like, or a process which comprises graft-polymerizing the monomer on the toner surface. The latter process is preferably applied to capsule toners which are prepared by interfacial polymerization as described above.

The spray drying process involves spraying of a solution or dispersion of the polymer together with toner particles on a stream of hot air to remove a volatile component, whereby the polymer is coated on the toner surface. The coacervation process is a coating process utilizing a phase separation phenomenon of a solution of the polymer. The interfacial precipitation process comprises dispersing toner particles in a solution of the polymer, re-dispersing the dispersion in a solvent immiscible with the polymer solution to form a complex emulsion, and removing the solvents under heat or reduced pressure, or by solvent-extraction, freeze-drying or the like. The graft-polymerization process is a process of forming a polymer in such a manner that it chemically bonds to a polymer constituting the surface portion of toner particles.

The coated amount of the polymer on the toner surface is generally from 0.1 to 50% by weight, preferably from 0.5 to 10% by weight, based on the weight of the toner (not including the weight of the coated polymer).

As the monomer to be used in the present invention, preferred are vinyl monomers, particularly vinyl monomers containing a quaternary ammonium as cationic component and halogen ion, p-toluenesulfonate acid ion and/or methylsulfate ion as anionic component.

Examples of vinyl monomers containing a quaternary ammonium group as cationic component and halogen ions as anionic components include acrylic or methacrylic (correctivity referred to as "(meth)acrylic") acid ester ammonium salt monomers such as acryloyloxyethyltrimethylammonium chloride, acryloyloxyethyltriethylammonium chloride, methacryloyloxyethyldimethylethylammonium chloride, methacryloyloxyethyldimethylbenzylammonium chloride and methacryloyloxyethylbenzylammonium chloride; (meth)acrylamide ammonium salt monomers such as acrylamide trimethylpropylammonium chloride, acrylamide triethylpropylammonium chloride and methacrylamide benzylpropylammonium chloride; vinylbenzyl ammonium salt monomers such as vinylbenzylethylammonium chloride and vinylbenzyltrimethylammonium chloride; vinylpyridium salt monomers such as N-butylvinylpyridinium bromide and N-cetylvinylpyridinium chloride; and vinylimidazolinium salt monomers such as N-vinyl-2-methylimidazolinium chloride and N-vinyl-2,3-dimethylimidazolinium chloride.

Examples of vinyl monomers containing a quaternary ammonium group as cationic component and p-toluenesulfonate acid ions as anionic components include (meth)acrylic ester ammonium salt monomers such as acryloyloxyethyltrimethylammonium p-toluenesulfonate, acryloyloxyethyltriethylammonium p-toluenesulfonate, methacryloyloxyethyltrimethylammonium p-toluenesulfonate, methacryloyloxyethyltriethylammonium p-toluenesulfonate and methacryloyloxyethyldimethylbenzylammonium p-toluenesulfonate; (meth)acrylamide ammonium salt monomers such as acrylamide trimethylpropylammonium p-toluenesulfonate, acrylamide triethylpropylammonium p-toluenesulfonate and methacrylamide dimethylbenzylpropylammonium p-toluenesulfonate; vinylbenzyl ammonium salt monomers such as vinylbenzyldimethylethylammonium p-toluenesulfonate and vinylbenzyltrimethylammonium p-toluenesulfonate; vinyl pyridinium salt monomers such as N-butylvinylpyridinium p-toluenesulfonate and N-cetylvinylpyridinium p-toluenesulfonate; and vinylimidazolinium salt monomers such as N-vinyl-N'-methylimidazolinium p-toluenesulfonate and N-vinyl-2,3-dimethylimidazolinium p-toluenesulfonate.

Examples of vinyl monomers containing a quaternary ammonium group as cationic component and methylsulfate ion as anionic component include (meth)acrylic ester ammonium salt monomers such as acryloyloxyethyltrimethylammonium methylsulfate, acryloyloxyethyldiethylmethylammonium methylsulfate, methacryloyloxyethyltrimethylammonium methylsulfate, methacryloyloxyethyldiethylmethylammonium methylsulfate and methacryloyloxyethyldimethylbenzyl methylsulfate; (meth)acrylamide ammonium salt monomers such as acrylamide trimethylpropylammonium methylsulfate, acrylamide dimethylethylpropylammonium methylsulfate, methacrylamide dimethylbenzylpropylammonium methylsulfate and methacrylamide methylbenzylpropylammonium methylsulfate; vinylbenzyl ammonium salt monomers such as vinylbenzyldimethylethylammonium methylsulfate and vinylbenzyltrimethylammonium methylsulfate; vinylpyridinium salt monomers such as N-butylvinylpyridinium methylsulfate and N-cetylvinylpyridinium methylsulfate; and vinylimidazolinium salt monomers such as N-vinyl-N'-methylimidazolinium methylsulfate and N-vinyl-2,3-dimethylimidazolinium methylsulfate.

These monomers may be used singly or as a mixture thereof to form a polymer on the surface of toner particles. These monomers may also be copolymerized with other monomers to form a copolymer. In the latter case, the content of the above mentioned monomer in the copolymer is from 1 to 80 mol %, preferably 5 to 60 mol %.

Examples of monomers to be copolymerized with the above mentioned monomer include (meth)acrylic acid esters such as (meth)acrylic acid, methyl (meth)acrylate, ethyl (meth)acrylate, propyl (meth)acrylate, butyl (meth)acrylate, pentyl (meth)acrylate, hexyl (meth)acrylate, lauryl (meth)acrylate, cyclohexyl (meth)acrylate, 2-ethylhexyl (meth)acrylate, benzyl (meth)acrylate, hydroxyethyl (meth)acrylate, hydroxypropyl (meth)acrylate, 2-ethoxyethyl (meth)acrylate, glycidyl (meth)acrylate and phenyl (meth)acrylate; aliphatic vinylesters such as vinyl formate, vinyl acetate, vinyl propionate, vinyl lactate, vinyl trimethylacetate, vinyl caproate, vinyl caprate and vinyl stearate; vinylethers such as ethyl vinyl ether, propyl vinyl ether, butyl vinyl ether, hexyl vinyl ether, 2-ethylhexyl vinyl ether and phenyl vinyl ether; vinyl ketones such as methyl vinyl ketone and phenyl vinyl ketone; and vinyl aromatic compounds such as styrene, chlorostyrene, hydroxystyrene and $\beta$-methylstyrene. One or more of these monomers in admixture can be copolymerized with the above mentioned monomer. Particularly preferred are (meth)acrylic acid esters.

Toner particles having the polymer provided on the surface thereof are then subjected to ion exchange so that the anionic component of the polymer is exchanged with another anion.

In the present invention, ion exchange means a process which comprises partially or entirely exchanging the anionic component of the above mentioned polymer present on the toner surface of with another anion. In particular, a sodium salt or potassium salt of the corresponding anion is dissolved in deionized water. Toner particles are added to the aqueous solution or the aqueous solution is added to the toner particles, so that the anionic component is converted to the corresponding anion. The toner particles are then washed with water. Any water-soluble sodium salt or potassium salt capable of being ion-exchanged with the anionic component can be used.

It is preferred that at least 10 mol % of the anion component of the polymer be converted to another anion component in the ion exchange treatment of the present invention based on the total amount of the anion component in the polmyer.

Examples of anions to be used in ion exchange include aliphatic carboxylic acid group such as $CH_3CO_2^-$, $CH_3CH_2CO_2^-$, $CH_3CH_2CH_2CO_2^-$ and $CH_3(CH_2)_6CO_2^-$; aromatic carboxylic acid group such as

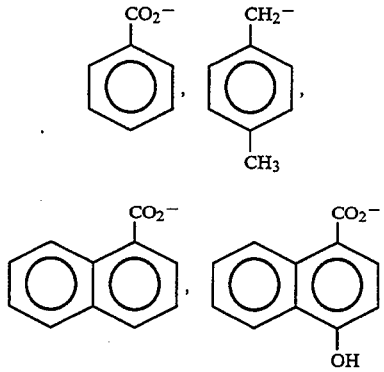

aromatic sulfonic acid group such as

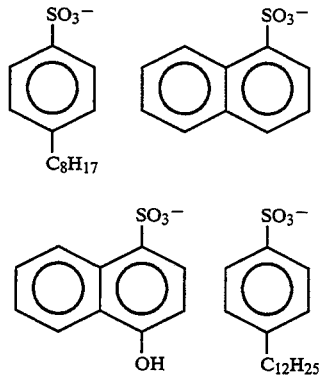

and anions of sulfate such as sodium laurylsulfate. Alternatively, anionic residues of acid dye such as acid red, acid orange, acid violet and acid blue may be used. If the anionic component of the vinyl monomer is halogen ion,

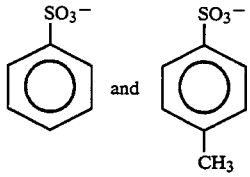

may also be used as anion to be used in ion exchange.

Preferred examples of compounds to be used in ion exchange to provide such anions include carboxylate such as sodium acetate, potassium acetate, sodium butyrate, sodium caprate and potassium naphthylacetate; sulfonate such as sodium p-styrenesulfonate, sodium naphthalenesulfonate, sodium 4-hydroxynaphthalenesulfonate, sodium laurylbenzenesulfonate, sodium dedecylbenzenesulfonate and sodium naphthoquinonesulfonate; and sulfate such as sodium laurylsulfate and sodium dodecylsulfate. Further, acid dyes such as acid yellow, acid red, acid violet and acid blue may be used.

In order to enchance the fluidity or chargeability of toner, silicon oxide, aluminum oxide, titanium oxide, carbon black and the like may be added as external additive. The addition of such additives can be accomplished by a process which comprises drying a toner, and then allowing such additives to be attached to the toner surface by means of a mixer such as V-shaped blender and Henschel mixer, or a process which comprises dispersing such additives in water or an aqueous liquid such as a mixture of water and alcohol, adding the dispersion to a slurry of toner, and then drying the toner.

As mentioned above, the present process can enjoy a high degree of freedom of selection of anion and save time and labor in monomer synthesis and requires no special reactor or complicated operation. In accordance with the present process, an electrophotographic toner comprising on the surface thereof a polymer containing desired anions can be easily and economically prepared. The electrophotographic toner thus prepared exhibits an excellent chargeability and a high environmental stability of chargeability.

The present invention will be further described in the following examples, but the present invention should not be construed as being limited thereto.

EXAMPLE 1

(Preparation of capsulized particles)

50 g of a polylauryl methacrylate (molecular weight: $5\times10^4$) and 30 g of a polyisobutyl methacrylate (molecular weight: $16\times10^4$) were dissolved in a mixture of 10 g of dibutyl naphthalene, 40 g of Isopar H (Exxon Chemical) and 40 g of ethyl acetate. 120 g pf a magnetic powder (EPT-1000 available from Toda Kogyo K.K.) was then added to the solution. The material was subjected to dispersion in a ball mill for 16 hours. 200 g of the dispersion was then thoroughly mixed with 30 g of isocyanate (Sumidur L available from Sumitomo Bayer Urethane K.K.) and 24 g of ethyl acetate to prepare Solution A. On the other hand, 10 g of hydroxypropylmethyl cellulose (Metolose 65SH50 available from Shin-Etsu Chemical Industry Co., Ltd.) was dissolved in 200 g of ion-exhanged water. The solution was cooled to a temperature of 5° C. to prepare Solution B. Solution A was gradually added into Solution B with stirring in an emulsifier (automatic homomixer available from Tokushuki Kako K.K.) to effect emulsification. Thus, an oil-in-water type emulsion comprising oil drops with an average particle diameter of about 12 μm was obtained. The emulsion was stirred at 400 rpm by an agitator (Three-One Motor available from Shinto Kagaku K.K.) equipped with propeller blades instead of emulsifier. After 10 minutes, 100 g of a 5% aqueous solution of diethylene triamine was added dropwise to the emulsion. After completion of the dropwise addition, the material was heated to a temperature of 60° C. where it was then allowed to undergo encapsulation reaction for 3 hours. After completion of the reaction, the reaction product was then poured into 2 liters of ion-exchanged water. The material was thoroughly stirred, and then allowed to stand. After capsulized particles were precipitated, the supernatant solution was removed. This procedure was repeated seven times to wash the capsulized particles. Thus, capsulized particles containing an oily binder were obtained. Ion-exchanged water was added to the capsulized particles to prepare a suspension with a solid content of 40%.

(Preparation of toner)

125 g of ion-exchanged water was added to 125 g (corresponding to 50 g of capsulized particles) of the suspension of capsulized particles thus prepared. The resultant was then stirred at 200 rpm in an agitator equipped with propeller blades (Three-One Motor available from Shinto Kagaku K.K.). 5 g of 1N nitric acid and 4 g of a 10% aqueous solution of serium sulfate were added to the resulting suspension, and 0.5 g of ethylene glycol dimethacrylate was then added. The mixture was allowed to undergo reaction at a temperature of 15° C. for 3 hours. After completion of the reaction, the reaction product was poured into 1 liter of ion-exchanged water, thoroughly stirred, and then allowed to stand. After the capsulized particles were precipitated, the supernatant solution was removed from the reaction system. This procedure was repeated twice to wash the capsulized particles. Thus, capsulized particles comprising ethylene glycol dimethacrylate graft-polymerized on the surface of the shell thereof were obtained.

The capsulized particles were again suspended in ion-exchanged water. The suspension was then stirred at 200 rpm in an agitator equipped with propeller blades (Three-One Motor available from Shinto Kagaku K.K.). 0.4 g of potassium persulfate, 0.2 g of N-cetylvinylpyridinium chloride, 2.0 g of methyl methacrylate, and 0.16 g of sodium hydrogensulfite were sequentially added to the suspension, which was then allowed to undergo reaction at a temperature of 25° C. for 3 hours. After completion of the reaction, the reaction product was poured into 2 liters of ion-exchanged water. The reaction product was thoroughly stirred, and then allowed to stand. After the capsulized particles were precipitated, the supernatant solution was removed. This procedure was repeated four times to wash the capsulized particles.

2 g of a 5% aqueous solution of sodium 1-naphthalenesulfonate was added to the suspension of capsulized particles thus prepared. The suspension was then stirred at room temperature for 30 minutes to effect ion exchange reaction. After completion of the reaction, the capsulized particles were washed with 1 liter of ion-exchanged water five times to obtain a capsule toner of the present invention. The capsule suspension thus obtained was then poured into a stainless steel tray and dried at a temperature of 60° C. in a dryer (available from Yamato Kagaku K.K.) for 10 hours.

3 g of the capsule toner thus obtained was then mixed with 100 g of an iron powder carrier covered with a phenolic resin in an environment of a temperature of 20° C. and a humidity of 50% and the charged amount of the toner was measured by blow-off process. The result was +23 μC/g. Similarly, the capsule toner was mixed with the iron powder carrier in an environment of a temperature of 28° C. and a humidity of 80% and the charged amount was measured by blow-off process. The result was +20 μC/g.

1 part of a hydrophobic silica (RA-200H available from Nihon Aerogel K.K.) was added to and thoroughly mixed with 100 parts of the toner. The toner was then evaluated for image quality in a high temperature and humidity environment of 35° C. and 85% RH. Fuji Xerox 2700 which had been modified for use with capsule toner was used as a copying machine. As a result, 20,000 sheets of stable copies with no fog were obtained.

Comparative Example 1

A capsule toner was prepared in the same manner as in Example 1 except that an aqueous solution of sodium 1-naphthalenesulfonate was not added to the system. The capsule toner had a chlorine anion left as it was.

3 g of the capsule toner thus obtained was then mixed with 100 g of an iron powder carrier covered with a phenolic resin in an environment of a temperature of 20° C. and a humidity of 50% and the charged amount was measured by blow-off process. The result was +20 μC/g. Similarly, the capsule toner was mixed with the iron powder carrier in an environment of a temperature of 28° C. and a humidity of 80%. The charge amount measured by blow-off process was +4 μC/g.

1 part of a hydrophobic silica (RA-200H available from Nihon Aerogel K.K.) was added to and thoroughly mixed with 100 parts of the toner. The toner was then evaluated for image quality in a high temperature and humidity environment of 35° C. and 85% RH as in Example 1. As a result, fog occured as early as on the first sheet of copy. The 100th sheet of copy exhibited a drop in image density and hence an image quality with an extremely poor sharpness.

EXAMPLE 2

125 g of ion-exchanged water was added to 125 g (corresponding to 50 g of capsulized particles) of the suspension of capsulized particles as prepared in Example 1. The material was then stirred at 200 rpm in an agitator equipped with propeller blades (Three-One Motor available from Shinto Kagaku K.K.). 5 g of 1N nitric acid and 4 g of a 10% aqueous solution of serium (IV) ammonium sulfate were added to the resulting suspension. 0.5 g of ethylene glycol dimethacrylate was then added thereto. The resulting mixture was allowed to undergo reaction at a temperature of 15° C. for 3 hours. After completion of the reaction, the reaction product was poured into 1 liter of ion-exchanged water, thoroughly stirred, and then allowed to stand. After the capsulized particles were precipitated, the supernatant solution was removed. This procedure was repeated twice to wash the capsulized particles. Thus, capsulized particles comprising ethylene glycol dimethacrylate graft-polymerized on the surface of the shell thereof were obtained.

The capsulized particles were again suspended in ion-exchanged water. The suspension was then stirred at 200 rpm in an agitator equipped with propeller blades (Three-One Motor available from Shinto Kagaku K.K.). 0.4 g of potassium persulfate, 0.2 g of vinylbenzyl trimethylammonium chloride, 2.0 g of ethyl acrylate, and 0.16 g of sodium hydrogensulfite were sequentially added to the suspension. The suspension was then allowed to undergo reaction at a temperature of 25° C. for 3 hours. After completion of the reaction, the reaction product was poured into 2 liters of ion-exchanged water. The reaction product was thoroughly stirred, and then allowed to stand. After the capsulized particles were precipitated, the supernatant solution was removed. This procedure was repeated four times to wash the capsulized particles.

2 g of a 5% aqueous solution of sodium acetate was added to the suspension of capsulized particles thus prepared. The suspension was then stirred at room temperature for 30 minutes to effect an ion exchange reaction. After completion of the reaction, the capsulized particles were washed with 1 liter of ion-exchanged water five times to obtain a capsule toner of the present invention. The capsule suspension thus obtained was then poured into a stainless steel tray. The material was dried at a temperature of 60° C. in a dryer (available from Yamato Kagaku K.K.) for 10 hours.

3 g of the capsule toner thus obtained was then mixed with 100 g of an iron powder carrier covered with a phenolic resin in an environment of a temperature of 20° C. and a humidity of 50%.and the charged amount was measured by blow-off process. The result was +21

μC/g. Similarly, the capsule toner was mixed with the iron powder carrier in an environment of a temperature of 28° C. and a humidity of 80%. The charged amount measured by blow-off process was +19 μC/g.

1 part of a hydrophobic silica (RA200H available from Nihon Aerogel K.K.) was added to and thoroughly mixed with 100 parts of the toner. The toner was then evaluated for image quality in a high temperature and humidity environment of 35° C. and 85% RH using a copying machine Fuji Xerox 2700 which had been modified for use with capsule toner. As a result, 20,000 sheets of stable copies without fog were obtained.

Comparative Example 2

A capsule toner was prepared in the same manner as in Example 2 except that an aqueous solution of sodium acetate was not added to the system. The capsule toner had a chlorine anion left as it was.

3 g of the capsule toner thus obtained was then mixed with 100 g of an iron powder carrier covered with a phenolic resin in an environment of a temperature of 20° C. and a humidity of 50% and the charged amount was measured by blow-off process. The result was +14 μC/g. Similarly, the capsule toner was mixed with the iron powder carrier in an environment of a temperature of 28° C. and a humidity of 80%. The charged amount measured by blow-off process was +4 μC/g.

1 part of a hydrophobic silica (RA-200H available from Nihon Aerogel K.K.) was added to and thoroughly mixed with 100 parts of the toner. The toner was then evaluated for image quality in a high temperature and humidity environment of 35° C. and 85% RH as in Example 1. As a result, fog occured as early as on the first sheet of copy. The 50th sheet of copy exhibited a drop in image density and hence an image quality with an extremely poor sharpness.

EXAMPLE 3

(Preparation of capsulized particles)

120 g of a lauryl methacrylate monomer and 20 g of a petroleum resin (FTR-6125 available from Mitsui Petrochemical Industries, Ltd.) were dissolved in a mixture of 20 g of a saturated hydrocarbon solvent (Isopar-H available from Exxon Chemical) and 20 g of ethyl acetate. 120 g of a magnetic powder which had been subjected to hydrophobic treatment with a titanium coupling agent was then added to the solution. The mixture was subjected to dispersion in a ball mill for 24 hours. 200 g of the dispersion was then mixed with 10 g of isocyanate (Sumidur L available from Sumitomo Bayer Urethane K.K.), 5 g of toluylene diisocyanate (Coronate T available from Nihon Polyurethane K.K.), 4 g of an epoxy resin (Epikote 812 available from Yuka Shell Epoxy Co.) and 4 g of azobisisobutylonitrile to prepare Solution A'. On the other hand, 10 g of hydroxypropylmethyl cellulose (Metolose 65SH50 available from Shin-Etsu Chemical Industry Co., Ltd.) was dissolved in 250 g of ion-exhanged water. The solution was cooled to a temperature of 5° C. to prepare Solution B'. Solution A' was gradually charged into Solution B' with stirring in an emulsifier (automatic homomixer available from Tokushuki Kako K.K.) to effect emulsification. Thus, an oil-in-water type emulsion comprising oil drops with an average particle diameter of about 12 μm was obtained. The emulsion was stirred at 400 rpm by an agitator (Three-One Motor available from Shinto Kagaku K.K.) equipped with propeller blades instead of emulsifier. After 10 minutes, 100 g of a 2.5% aqueous solution of diethylene triamine was added dropwise to the emulsion. After completion of the dropwise addition, the mixture was further stirred at an elevated temperature of 65° C. where it was then allowed to undergo encapsulation reaction for 3 hours while ethyl acetate was being removed. The resultant was then allowed to undergo reaction at a temperature of 65° C. for 14 hours to effect polymerization of core substance. After completion of the reaction, the reaction product was then poured into 2 liters of ion-exchanged water. The material was thoroughly stirred, and then allowed to stand. After the capsulized particles were precipitated, the supernatant solution was removed from the material. This procedure was repeated five times to wash the capsulized particles. Ion-exchanged water was added to the capsulized particles to prepare a suspension with a solid content of 40%.

(Preparation of toner)

125 g of ion-exchanged water was added to 125 g (corresponding to 50 g of capsulized particles) of the suspension of capsulized particles thus prepared. The suspension was then stirred at 200 rpm in an agitator equipped with propeller blades (Three-One Motor available from Shinto Kagaku K.K.). 5 g of 1N nitric acid and 4 g of a 10% aqueous solution of serium (IV) sulfate were added to the suspension. 0.5 g of ethylene glycol dimethacrylate was then added thereto. The resultant was allowed to undergo reaction at a temperature of 15° C. for 3 hours. After completion of the reaction, the reaction product was poured into 1 liter of ion-exchanged water, thoroughly stirred, and then allowed to stand. After the capsulized particles were precipitated, the supernatant solution was removed. This procedure was repeated twice to wash the capsulized particles. Thus, capsulized particles comprising ethylene glycol dimethacrylate graft-polymerized on the surface of the shell thereof were obtained.

The capsulized particles were again suspended in ion-exchanged water. The suspension was then stirred at 200 rpm in an agitator equipped with propeller blades (Three-One Motor available from Shinto Kagaku K.K.). 0.4 g of potassium persulfate, 0.2 g of methacryloyloxyethyltrimethylammonium chloride, 2.0 g of methacrylate, and 0.16 g of sodium hydrogensulfite were sequentially added to the suspension. The suspension was then allowed to undergo reaction at a temperature of 25° C. for 3 hours. After completion of the reaction, the reaction product was poured into 2 liters of ion-exchanged water. The reaction product was thoroughly stirred, and then allowed to stand. After the capsulized particles were precipitated, the supernatant solution was removed from the system. This procedure was repeated four times to wash the capsulized particles.

2 g of a 5% aqueous solution of an acidic dye (Fast Red A available from Wako Junyaku K.K.) was added to the suspension of capsulized particles thus prepared. The suspension was then stirred at room temperature for 30 minutes to effect ion exchange reaction. After completion of the reaction, the capsulized particles were washed with 1 liter of ion-exchanged water five times to obtain a capsule toner of the present invention. The capsule suspension thus obtained was then poured into a stainless steel tray. The material was dried at a temperature of 60° C. in a dryer for 10 hours.

3 g of the capsule toner thus obtained was then mixed with 100 g of an iron powder carrier covered with a phenolic resin in an environment of a temperature of 20° C. and a humidity of 50% and the charged amount of the toner was measured by blow-off process. The result was +18 μC/g. Similarly, the capsule toner was mixed with the iron powder carrier in an environment of a temperature of 28° C. and a humidity of 80%. The charged amount measured by blow-off process was +14 μC/g.

1 part of an alumina treated with a titanium coupling agent was added to and thoroughly mixed with 100 parts of the toner. The toner was then evaluated for image quality in a high temperature and humidity environment of 35° C. and 85% RH using a copying machine Fuji Xerox 2700 which had been modified for use with capsule toner. As a result, 20,000 sheets of stable copies free of fog were obtained.

Comparative Example 3

A capsule toner was prepared in the same manner as in Example 3 except that an aqueous solution of an acidic dye (Fast Red A available from Wako Junyaku K.K.) was not added to the system. The capsule toner had a chlorine anion left as it was.

3 g of the capsule toner thus obtained was then mixed with 100 g of an iron powder carrier covered with a phenolic resin in an environment of a temperature of 20° C. and a humidity of 50% and the charged amount was measured by blow-off process. The result was +20 μC/g. Similarly, the capsule toner was mixed with the iron powder carrier in an environment of a temperature of 28° C. and a humidity of 80%. The charged amount measured by blow-off process was +4 μC/g. 1 part of an alumina treated with a titanium couping agent was added to and thoroughly mixed with 100 parts of the toner. The toner was then evaluated for image quality in a high temperature and humidity environment of 35° C. and 85% RH as in Example 1. As a result, fog occured as early as on the first sheet of copy. The 50th sheet of copy exhibited a drop in image density and hence an image quality with an extremely poor sharpness.

EXAMPLE 4

125 g of ion-exchanged water was added to 125 g (corresponding to 50 g of capsulized particles) of the suspension of capsulized particles as prepared in Example 1. The mixture was then stirred at 200 rpm in an agitator equipped with propeller blades (Three-One Motor available from Shinto Kagaku K.K.). 5 g of 1N nitric acid and 4 g of a 10% aqueous solution of serium sulfate were added to the resulting suspension. 0.5 g of ethylene glycol dimethacrylate was then added thereto. The mixture was then allowed to undergo reaction at a temperature of 15° C. for 3 hours. After completion of the reaction, the reaction product was poured into 1 liter of ion-exchanged water, thoroughly stirred, and then allowed to stand. After the capsulized particles were precipitated, the supernatant solution was removed from the system. This procedure was repeated twice to wash the capsulized particles. Thus, capsulized particles comprising ethylene glycol dimethacrylate graft-polymerized on the surface of the shell thereof were obtained.

The capsulized particles were again suspended in ion-exchanged water. The suspension was then stirred at 200 rpm in an agitator equipped with propeller blades (Three-One Motor available from Shinto Kagaku K.K.). 0.4 g of potassium persulfate, 0.4 g of methacryloyloxyethyltrimethylammonium p-toluenesulfonate, 2.0 g of methyl acrylate, and 0.16 g of sodium hydrogensulfite were sequentially added to the suspension. The suspension was then allowed to undergo reaction at a temperature of 25° C. for 3 hours. After completion of the reaction, the reaction product was poured into 2 liters of ion-exchanged water. The reaction product was thoroughly stirred, and then allowed to stand. After the capsulized particles were precipitated, the supernatant solution was removed from the system. This procedure was repeated four times to wash the capsulized particles.

2 g of a 5% aqueous solution of sodium 4-hydroxy-1-naphthalenesulfonate was added to the suspension of capsulized particles thus prepared. The suspension was then stirred at room temperature for 30 minutes to effect ion exchange reaction. After completion of the reaction, the capsulized particles were washed with 1 liter of ion-exchanged water five times to obtain a capsule toner of the present invention. The capsule suspension thus obtained was then poured into a stainless steel tray and dried at a temperature of 60° C. in a dryer (available from Yamato Kagaku K.K.) for 10 hours.

3 g of the capsule toner thus obtained was then mixed with 100 g of an iron powder carrier covered with a phenolic resin in an environment of a temperature of 20° C. and a humidity of 50% and the charged amount of the toner was measured by blow-off process. The result was +23 μC/g. Similarly, the capsule toner was mixed with the iron powder carrier in an environment of a temperature of 28° C. and a humidity of 80%. The charged amount measured by blow-off process was +20 μC/g.

1 part of a hydrophobic silica (RA-200H available from Nihon Aerogel K.K.) was added to and thoroughly mixed with 100 parts of the toner. The toner was then evaluated for image quality in a high temperature and humidity environment of 35° C. and 85% RH using a copying machine Fuji Xerox 2700 which had been modified for use with capsule toner. As a result, 20,000 sheets of stable copies free of fog were obtained.

Comparative Example 4

A capsule toner was prepared in the same manner as in Example 4 except that an aqueous solution of sodium 4-hydroxy-4-naphthalenesulfonate was not added to the system. The capsule toner had a p-toluenesulfonic anion left as it was.

3 g of the capsule toner thus obtained was then mixed with 100 g of an iron powder carrier covered with a phenolic resin in an environment of a temperature of 20° C. and a humidity of 50%, and the charge amount was measured by blow-off process. The result was +20 μC/g. Similarly, the capsule toner was mixed with the iron powder carrier in an environment of a temperature of 28° C. and a humidity of 80%. The charge amount measured by blow-off process was +10 μC/g.

1 part of a hydrophobic silica (RA-200H available from Nihon Aerogel K.K.) was added to and thoroughly mixed with 100 parts of the toner. The toner was then evaluated for image quality in a high temperature and humidity environment of 35° C. and 85% RH as in Example 1. As a result, fog occured as early as on the first sheet of copy. The 100th sheet of copy exhibited a drop in image density and hence an image quality with an extremely poor sharpness.

EXAMPLE 5

125 g of ion-exchanged water was added to 125 g (corresponding to 50 g of capsulized particles) of the suspension of capsulized particles as prepared in Example 4. The material was then stirred at 200 rpm in an agitator equipped with propeller blades (Three-One Motor available from Shinto Kagaku K.K.). 5 g of 1N nitric acid and 4 g of a 10% aqueous solution of serium sulfate were added to the suspension. 0.5 g of ethylene glycol dimethacrylate was then added thereto. The mixture was allowed to undergo reaction at a temperature of 15° C. for 3 hours. After completion of the reaction, the reaction product was poured into 1 liter of ion-exchanged water, thoroughly stirred, and then allowed to stand. After the capsulized particles were precipitated, the supernatant solution was removed from the system. This procedure was repeated twice to wash the capsulized particles. Thus, capsulized particles comprising ethylene glycol dimethacrylate graft-polymerized on the surface of the shell thereof were obtained.

The capsulized particles were again suspended in ion-exchanged water. The suspension was then stirred at 200 rpm in an agitator equipped with propeller blades (Three-One Motor available from Shinto Kagaku K.K.). 0.4 g of potassium persulfate, 0.2 g of methacryloyloxyethyltrimethylammonium p-toluenesulfonate, 2.0 g of methyl methacrylate, and 0.16 g of sodium hydrogensulfite were sequentially added to the emulsion. The emulsion was then allowed to undergo reaction at a temperature of 25° C. for 3 hours. After completion of the reaction, the reaction product was poured into 2 liters of ion-exchanged water. The reaction product was thoroughly stirred, and then allowed to stand. After the capsulized particles were precipitated, the supernatant solution was removed from the system. This procedure was repeated four times to wash the capsulized particles.

2 g of a 5% aqueous solution of sodium acetate was added to the suspension of capsulized particles thus prepared. The suspension was then stirred at room temperature for 30 minutes to effect ion exchange reaction. After completion of the reaction, the capsulized particles were washed with 1 liter of ion-exchanged water five times to obtain a capsule toner of the present invention. The capsule suspension thus obtained was then poured into a stainless steel tray and dried at a temperature of 60° C. in a dryer (available from Yamato Kagaku K.K.) for 10 hours.

3 g of the capsule toner thus obtained was then mixed with 100 g of an iron powder carrier covered with a phenolic resin in an environment of a temperature of 20° C. and a humidity of 50% and measured for charging by blow-off process. The result was +21 μC/g. Similarly, the capsule toner was mixed with the iron powder carrier in an environment of a temperature of 28° C. and a humidity of 80%. The charged amount measured by blow-off process was +19 μC/g.

0.5 part of a hydrophobic silica (RA-200H available from Nihon Aerogel K.K.) was added to and thoroughly mixed with 100 parts of the toner. The toner was then evaluated for image quality in a high temperature and humidity environment of 35° C. and 85% RH using a copying machine Fuji Xerox 2700 which had been modified for use with capsule toner. As a result, 20,000 sheets of stable copies free of fog were obtained.

Comparative Example 5

A capsule toner was prepared in the same manner as in Example 5 except that an aqueous solution of sodium acetate was not added to the system. The capsule toner had a p-toluenesulfonic anion left as it was.

3 g of the capsule toner thus obtained was then mixed with 100 g of an iron powder carrier covered with a phenolic resin in an environment of a temperature of 20° C. and a humidity of 50% and the charged amount was measured for charging by blow-off process. The result was +16 μC/g. Similarly, the capsule toner was mixed with the iron powder carrier in an environment of a temperature of 28° C. and a humidity of 80%. The charged amount measured by blow-off process was +10 μC/g.

0.5 part of a hydrophobic silica (RA-200H available from Nihon Aerogel K.K.) was added to and thoroughly mixed with 100 parts of the toner. The toner was then evaluated for image quality in a high temperature and humidity environment of 35° C. and 85% RH as in Example 5. As a result, fog occured as early as on the first sheet of copy. The 50th sheet of copy exhibited a drop in image density and hence an image quality with an extremely poor sharpness.

EXAMPLE 6

(Preparation of capsulized particles)

60 g of a polylauryl methacrylate (molecular weight: $5\times10^4$) and 20 g of a petroleum resin (FTR-6125 available from Mitsui Petrochemical Industries, Ltd.) were dissolved in a mixture of 40 g of a saturated hydrocarbon solvent (Isopar-H available from Exxon Chemical) and 60 g of ethyl acetate. 120 g of a magnetic powder which had been subjected to hydrophobic treatment with a titanium coupling agent was then added to the solution. The mixture was subjected to dispersion in a ball mill for 24 hours. 200 g of the dispersion was then mixed with 10 g of isocyanate (Sumidur L available from Sumitomo Bayer Urethane K.K.), 5 g of toluylene diisocyanate (Colonate T available from Nihon Polyurethane K.K.), 4 g of an epoxy resin (Epikote 812 available from Yuka Shell Epoxy Co.), and 4 g of azobisisobutylonitrile to prepare Solution A". On the other hand, 10 g of hydroxypropylmethyl cellulose (Metolose 65SH50 available from Shin-Etsu Chemical Industry Co., Ltd.) was dissolved in 250 g of ion-exhanged water. The solution was cooled to a temperature of 5° C. to prepare Solution B". Solution A" was gradually charged into Solution B" with stirring in an emulsifier (automatic homomixer available from Tokushuki Kako K.K.) to effect emulsification. Thus, an oil-in-water type emulsion comprising oil drops with an average particle diameter of about 12 μm was obtained. The emulsion was stirred at 400 rpm by an agitator (Three-One Motor available from Shinto Kagaku K.K.) equipped with propeller blades instead of emulsifier. After 10 minutes, 100 g of a 2.5% aqueous solution of diethylene triamine was added dropwise to the emulsion. After completion of the dropwise addition, the mixture was further stirred at room temperature where it was then allowed to undergo encapsulation reaction for 2 hours. The reaction system was further stirred at an elevated temperature of 65° C. where it was allowed to undergo encapsulation reaction for 3 hours while ethyl acetate was being removed. The material was then allowed to undergo reaction at a temperature of 65° C. for 14 hours to effect polymerization of core substance.

After completion of the reaction, the reaction product was then poured into 2 liters of ion-exchanged water. The material was thoroughly stirred, and then allowed to stand. After the capsulized particles were precipitated, the supernatant solution was removed from the material. This procedure was repeated five times to wash the capsulized particles. Ion-exchanged water was added to the capsulized particles to prepare a suspension with a solid content of 40%.

(Preparation of toner)

125 g of ion-exchanged water was added to 125 g (corresponding to 50 g of capsulized particles) of the suspension of capsulized particles thus prepared. The suspension was then stirred at 200 rpm in an agitator equipped with propeller blades (Three-One Motor available from Shinto Kagaku K.K.). 5 g of 1N nitric acid and 4 g of a 10% aqueous solution of serium sulfate were added to the suspension. 0.5 g of ethylene glycol dimethacrylate was then added thereto. The mixture was then allowed to undergo reaction at a temperature of 15° C. for 3 hours. After completion of the reaction, the reaction product was poured into 1 liter of ion-exchanged water, thoroughly stirred, and then allowed to stand. After the capsulized particles were precipitated, the supernatant solution was removed from the system. This procedure was repeated twice to wash the capsulized particles. Thus, capsulized particles comprising ethylene glycol dimethacrylate graft-polymerized on the surface of the shell thereof were obtained.

The capsulized particles were again suspended in ion-exchanged water. The suspension was then stirred at 200 rpm in an agitator equipped with propeller blades (Three-One Motor available from Shinto Kagaku K.K.). 0.4 g of potassium persulfate, 1.0 g of N-methylvinylpyridinium p-toluenesulfonate, 0.2 g of methyl methacrylate, and 0.16 g of sodium hydrogensulfite were sequentially added to the suspension. The suspension was then allowed to undergo reaction at a temperature of 25° C. for 3 hours. After completion of the reaction, the reaction product was poured into 2 liters of ion-exchanged water. The reaction product was thoroughly stirred, and then allowed to stand. After the capsulized particles were precipitated, the supernatant solution was removed from the system. This procedure was repeated four times to wash the capsulized particles.

5 g of a 5% aqueous solution of an acidic dye (Fast Red A available from Wako Junyaku K.K.) was added to the suspension of capsulized particles thus prepared. The suspension was then stirred at room temperature for 30 minutes to effect ion exchange reaction. After completion of the reaction, the capsulized particles were washed with 1 liter of ion-exchanged water five times to obtain a capsule toner of the present invention. The capsule suspension thus obtained was then poured into a stainless steel tray and dried at a temperature of 60° C. in a dryer (available from Yamato Kagaku K.K.) for 10 hours.

3 g of the capsule toner thus obtained was then mixed with 100 g of an iron powder carrier covered with a phenolic resin in an environment of a temperature of 20° C. and a humidity of 50%, and the charged amount of the toner was measured for charging by blow-off process. The result was 20 μC/g. Similarly, the capsule toner was mixed with the iron powder carrier in an environment of a temperature of 28° C. and a humidity of 80%. The charged amount measured by blow-off process +18 μC/g.

0.5 part of an alumina treated with a titanium coupling agent was added to and thoroughly mixed with 100 parts of the toner. The toner was then evaluated for image quality in a high temperature and humidity environment of 35° C. and 85% RH using a copying machine Fuji Xerox 2700 which had been modified for use with capsule toner. As a result, 20,000 sheets of stable copies free of fog were obtained.

Comparative Example 6

A capsule toner was prepared in the same manner as in Example 6 except that an aqueous solution of an acidic dye (Fast Red A available from Wako Junyaku K.K.) was not added to the system. The capsule toner had a p-toluenesulfonic anion left as it was.

3 g of the capsule toner thus obtained was then mixed with 100 g of an iron powder carrier covered with a phenolic resin in an environment of a temperature of 20° C. and a humidity of 50%, and the charged of the toner was measured for charging by blow-off process. The result was +18 μC/g. Similarly, the capsule toner was mixed with the iron powder carrier in an environment of a temperature of 28° C. and a humidity of 80%. The charged amount measured by blow-off process was +9 μC/g.

0.5 parts of an alumina treated with a titanium coupling agent was added to and thoroughly mixed with 100 parts of the toner. The toner was then evaluated for image quality in a high temperature and humidity environment of 35° C. and 85% RH as in Example 6. As a result, fog occured as early as on the first sheet of copy. The 100th sheet of copy exhibited a drop in image density and hence an image quality with an extremely poor sharpness.

EXAMPLE 7

(Preparation of capsule particles)

30 g of styrene-n-2-butyl methacrylate copolymer (molecular weight: 20,000) was dissolved in a mixture of 160 g of a lauryl methacrylate monomer and 30 g of ethyl acetate. 20 g of a red pigment (Fostapalm Scarlet GO available from Bayer) was added to the reaction system. The reaction system was subjected to dispersion in a ball mill for 16 hours. To 200 g of the dispersion were added 10 g of an isocyanate (Sumidur L available from Sumitomo Bayer Urethane K.K.), 4 g of toluylene diisocyanate (Coronate T available from Nippon Polyurethane Co., Ltd.), 4 g of an epoxy resin (Epikote 812 available from Yuka Shell Epoxy Co.) and 3 g of azobisisobutylonitrile with stirring to obtain Solution A'''.

On the other hand, 10 g of hydroxypropylmethyl cellulose (Metolose65SH50 available from Shin-Etsu Chemical Industry Co., Ltd.) was dissolved in 250 g of ion-exhanged water. The solution was cooled to a temperature of 5° C. to prepare Solution B'''. Solution A''' was gradually added into Solution B''' with stirring in an emulsifier (automatic homomixer available from Tokushuki Kako K.K.) to effect emulsification. Thus, an oil-in-water type emulsion comprising oil drops with an average particle diameter of about 12 μm was obtained. The emulsion was stirred at 400 rpm by an agitator (Three-One Motor available from Shinto Kagaku K.K.) equipped with propeller blades instead of emulsifier. After 10 minutes, 100 g of a 2.5% aqueous solution of diethylene triamine was added dropwise to the emulsion. After completion of the dropwise addition, the mixture was further stirred at an elevated temperature of 65° C. where it was then allowed to undergo encapsulation reaction for 2 hours. The reaction system was allowed to undergo reaction at a temperature of 65° C. for 18 hours to effect polymerization of core substance. After completion of the reaction, the reaction product was then poured into 1 liter of ion-exchanged water. The material was thoroughly stirred, and then subjected to centrifugal separation. After the capsulized particles were separated, the supernatant solution was removed. This procedure was repeated five times. The material was then washed with methanol. Thus, a reddish capsule toner was obtained. Ion-exchanged water was added to the capsulized particles to prepare a suspension with a solid content of 40%.

(Preparation of toner)

125 g of ion-exchanged water was added to 125 g (corresponding to 50 g of capsulized particles) of the suspension of capsulized particles thus prepared. The suspension was then stirred at 200 rpm in an agitator equipped with propeller blades (Three-One Motor available from Shinto Kagaku K.K.). 5 g of 1N nitric acid and 4 g of a 10% aqueous solution of serium sulfate were added to the suspension. 1.0 g of ethylene glycol dimethacrylate was then added thereto. The suspension was then allowed to undergo reaction at a temperature of 15° C. for 3 hours. After completion of the reaction, the reaction product was poured into 1 liter of ion-exchanged water, thoroughly stirred, and then subjected to centrifugal separation. After the capsulized particles were separated, the supernatant solution was removed from the system. This procedure was repeated twice to wash the capsulized particles. Thus, capsulized particles comprising ethylene glycol dimethacrylate graft-polymerized on the surface of the shell thereof were obtained.

The capsulized particles were again suspended in ion-exchanged water. The suspension was then stirred at 200 rpm in an agitator equipped with propeller blades (Three-One Motor available from Shinto Kagaku K.K.). 0.4 g of potassium persulfate, 0.3 g of methacryloyloxyethyltrimethylammonium methylsulfate, 3.0 g of methyl methacrylate, and 0.16 g of sodium hydrogensulfite were sequentially added to the suspension. The suspension was then allowed to undergo reaction at a temperature of 25° C. for 3 hours. After completion of the reaction, the reaction product was poured into 2 liters of ion-exchanged water. The reaction product was thoroughly stirred, and then subjected to centrifugal separation. After the capsulized particles were separated, the supernatant solution was removed from the system. This procedure was repeated four times to wash the capsulized particles.

2 g of a 5% aqueous solution of an acidic dye (Fast Red A available from Wako Junyaku K.K.) was added to the suspension of capsulized particles thus prepared. The suspension was then stirred at room temperature for 30 minutes to effect ion exchange reaction. After completion of the reaction, the capsulized particles were washed with 1 liter of ion-exchanged water five times to obtain a capsule toner of the present invention. The capsule suspension thus obtained was then poured into a stainless steel tray and dried at a temperature of 60° C. in a dryer (available from Yamato Kagaku K.K.) for 10 hours.

3 g of the capsule toner thus obtained was then mixed with 100 g of an iron powder carrier covered with a phenolic resin in an environment of a temperature of 20° C. and a humidity of 50%, and the charged amount of the toner was measured by blow-off process. The result was +18 μC/g. Similarly, the capsule toner was mixed with the iron powder carrier in an environment of a temperature of 28° C. and a humidity of 80%. The charged amount measured by blow-off process was +16 μC/g.

1 part of a hydrophobic silica (R972 available from Nihon Aerogel K.K.) was added to and thoroughly mixed with 100 parts of the toner. The toner was then evaluated for image quality in a high temperature and humidity environment of 35° C. and 85% RH using a copying machine Fuji Xerox 2700 which had been modified for use with capsule toner. As a result, 20,000 sheets of stable copies free of fog were obtained.

Comparative Example 7

A capsule toner was prepared in the same manner as in Example 7 except that an aqueous solution of an acidic dye (Fast Red A available from Wako Junyaku K.K.) was not added to the system. The capsule toner had the sulfuric methyl anion left as it was.

3 g of the capsule toner thus obtained was then mixed with 100 g of an iron powder carrier covered with a phenolic resin in an environment of a temperature of 20° C. and a humidity of 50%, and the charged amount of the toner was measured by blow-off process. The result was +20 μC/g. Similarly, the capsule toner was mixed with the iron powder carrier in an environment of a temperature of 28° C. and a humidity of 80%. The charged amount measured by blow-off process was +8 μC/g.

0.5 parts of a hydrophobic silica (RA-200H available from Nihon Aerogel K.K.) was added to and thoroughly mixed with 100 parts of the toner. The toner was then evaluated for image quality in a high temperature and humidity environment of 35° C. and 85% RH as in Example 7. As a result, fog occured as early as on the first sheet of copy. The 100th sheet of copy exhibited a drop in image density and hence an image quality with an extremely poor sharpness.

EXAMPLE 8

1.5 kg polyethylene wax (Hi-Fax 405MP available from Mitsui Petrochemical Industries, Ltd.) and a red pigment (Carmine 6BC available from Sumitomo Color Co., Ltd.) were melt-blended and solidified, followed by pulverization. The thus obtained particles were classified to obtain red polyethylene wax particles having an average particle size of 12 μm. 100 g of the particles was subjected to spray-drying together with a toluene solution of a copolymer of styrene and trimethylaminoethyl methacrylate chloride (copolymerization ratio 10:1), whereby red polyethylene particles coated with the above copolymer were obtained. Thereafter, the particles were subjected to the same ion exchange treatment as in Example 1 to prepare a toner.

3 g of the toner thus obtained was then mixed with 100 g of an iron powder carrier covered with a phenolic resin in an environment of a temperature of 20° C. and a humidity of 50% and the charged amount of the toner was measured by blow-off process. The result was +14 μC/g. Similarly, the capsule toner was mixed with the iron powder carrier in an environment of a temperature of 28° C. and a humidity of 80% and the charged amount was measured by blow-off process. The result was +12 μC/g.

1 part of a hydrophobic silica (R972 available from Nihon Aerogel K.K.) was added to and thoroughly mixed with 100 parts of the toner. The toner was then evaluated for image quality in a high temperature and humidity environment of 35° C. and 85% RH. Fuji Xerox 2700 which had been modified for use with pressure-fixing type toner was used as a copying machine. As a result, 20,000 sheets of stable copies with no fog were obtained.

Comparative Example 8

A toner was prepared in the same manner as in Example 8 except that an aqueous solution of sodium the ion exchange treatment was not carried out.

3 g of the toner thus obtained was then mixed with 100 g of an iron powder carrier covered with a phenolic resin in an environment of a temperature of 20° C. and a humidity of 50% and the charged amount was measured by blow-off process. The result was +8 μC/g. Similarly, the capsule toner was mixed with the iron powder carrier in an environment of a temperature of 28° C. and a humidity of 80%. The charge amount measured by blow-off process was +4 μC/g.

1 part of a hydrophobic silica (R972 available from Nihon Aerogel K.K.) was added to and thoroughly mixed with 100 parts of the toner. The toner was then evaluated for image quality in a high temperature and humidity environment of 35° C. and 85% RH as in Example 8. As a result, fog occured as early as on the first sheet of copy. The 50th sheet of copy exhibited a drop in image density and hence an image quality with an extremely poor sharpness.

While the invention has been described in detail and with reference to specific embodiments thereof, it will be apparent to one skilled in the art that various changes and modifications can be made therein without departing from the spirit and scope thereof.

What is claimed is:

1. A process for producing an electrophotographic toner, which comprises subjecting toner particles comprising on at least the surface thereof a polymer containing as a monomer component a monomer having a salt structure consisting of an anionic component and a cationic component, to ion exchange to replace said anionic component with another anionic component, wherein said monomer is a vinyl monomer, said anionic component is a halogen ion, said other anionic component is an aliphatic carboxylic acid group, an aromatic carboxylic acid group, an aromatic sulfonic acid group, an anion of sulfate, or an anionic residue of acid dye, and said cationic component is a quaternary ammonium group.

2. A process for producing an electrophotographic toner, which comprises chemically bonding a polymer containing as a monomer component a monomer having a salt structure consisting of an anionic component and a cationic component to the surface of toner particles, and then subjecting said toner particles to ion exchange to replace said anionic component with another anionic component, wherein said monomer is a vinyl monomer, said anionic component is a halogen ion, said other anionic component is an aliphatic carboxylic acid group, an aromatic carboxylic acid group, an aromatic sulfonic acid group, an anion of sulfate, or an anionic residue of acid dye, and said cationic component is a quaternary ammonium group.

3. A process for producing an electrophotographic toner as claimed in claim 1, wherein said toner particles have a capsule structure consisting of a core and a shell.

4. A process for producing an electrophotographic toner as claimed in claim 3, wherein said shell is a resin selected from the group consisting of a polyurea resin, a polyurethane resin, an epoxyurea resin, an epoxyurethane resin, a mixture of a polyurea resin and a polyurethane resin, or a mixture of an epoxyurea resin and an epoxyurethane resin.

* * * * *